US007040978B2

(12) United States Patent
Falk

(10) Patent No.: US 7,040,978 B2
(45) Date of Patent: May 9, 2006

(54) SLIDING DOOR DEVICE

(76) Inventor: Robert Falk, Barmer Strasse 10a, 58332 Schwelm (DE)

( * ) Notice: Subject to any disclaimer, the term of this patent is extended or adjusted under 35 U.S.C. 154(b) by 0 days.

(21) Appl. No.: 10/493,082

(22) PCT Filed: Oct. 15, 2002

(86) PCT No.: PCT/EP02/11489

§ 371 (c)(1),
(2), (4) Date: Apr. 16, 2004

(87) PCT Pub. No.: WO03/033907

PCT Pub. Date: Apr. 24, 2003

(65) Prior Publication Data

US 2004/0242146 A1 Dec. 2, 2004

(30) Foreign Application Priority Data

Oct. 17, 2001 (DE) ..... 201 16 803 U
May 31, 2002 (DE) ..... 102 24 527

(51) Int. Cl.
*F24F 9/00* (2006.01)

(52) U.S. Cl. ..... 454/188; 454/189

(58) Field of Classification Search ..... 454/191, 454/188, 189, 190, 192, 193
See application file for complete search history.

(56) References Cited

U.S. PATENT DOCUMENTS 3,049,984 A * 8/1962 Boysen ..... 454/192
3,350,994 A * 11/1967 Guibert ..... 454/190
4,074,620 A * 2/1978 Jansson ..... 454/190
5,090,069 A * 2/1992 Decaux ..... 4/662
6,375,562 B1 * 4/2002 Hein ..... 454/188
6,595,429 B1 * 7/2003 Carlson et al. ..... 236/44 R
6,874,331 B1 * 4/2005 Chandler et al. ..... 62/256

FOREIGN PATENT DOCUMENTS

DE 3806234 9/1989
DE 100 05 964 A1 8/2001
GB 967097 8/1964

OTHER PUBLICATIONS

Patent Abstracts of Japan, vol. 011, No. 215 (M-606), Jul. 11, 1987 & Jp 62 033234 A (Ebara Corp; Other: 01), Feb. 13, 1987.

* cited by examiner

*Primary Examiner*—Derek S. Boles
(74) *Attorney, Agent, or Firm*—Friedrich Kueffner

(57) ABSTRACT

The invention concerns a sliding door device (10) comprising at least a mobile sliding door (11) and separating elements (12) for maintaining and guiding the mobile and removable sliding door (11). The latter enables automatic opening and closure of an opening (20) based on a command. Therefor, the edges of the sliding door are at least partly enclosed with a frame part (14), an air curtain (24) being produced in front of the passageway (20) by means of a fan (16). The invention is characterized in that the sliding door comprises on its free vertical sides a frame part (14) provided with a housing wherein is arranged a fan (16). The outlet (17) of said fan leads to a longitudinal opening in the form of a nozzle producing the air curtain (24) and extending over practically the entire length of the vertical side (13) of the door. Additionally an inlet (18) of the fan (16) is provided in the frame part (14).

20 Claims, 2 Drawing Sheets

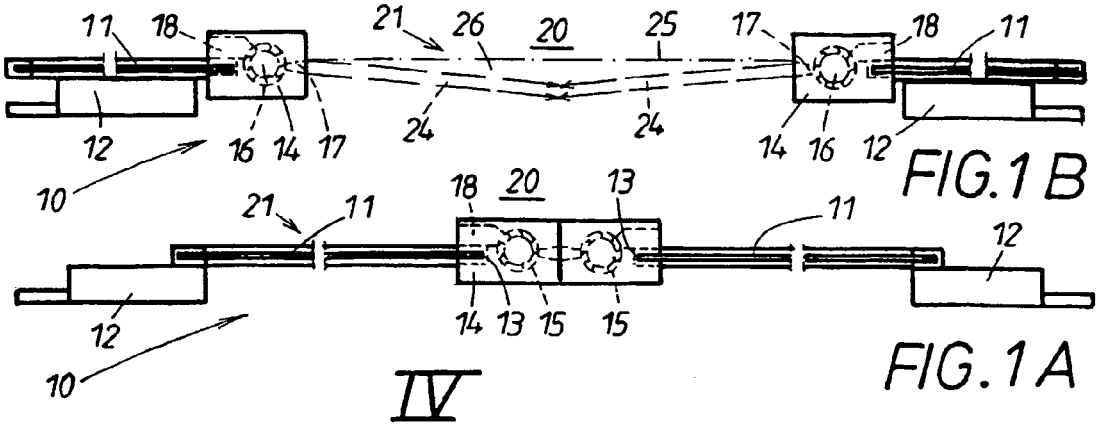
FIG. 1 B
FIG. 1 A
FIG. 2
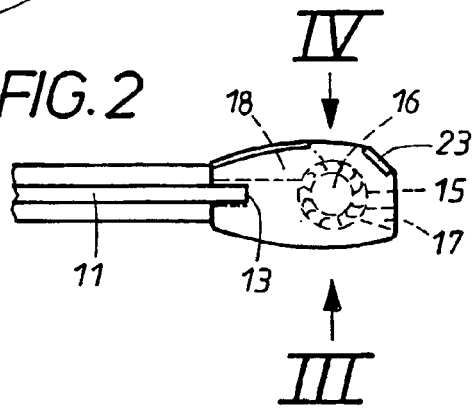
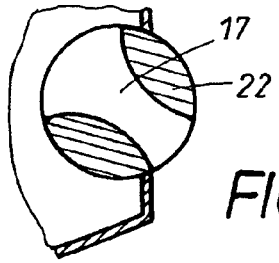
FIG. 5
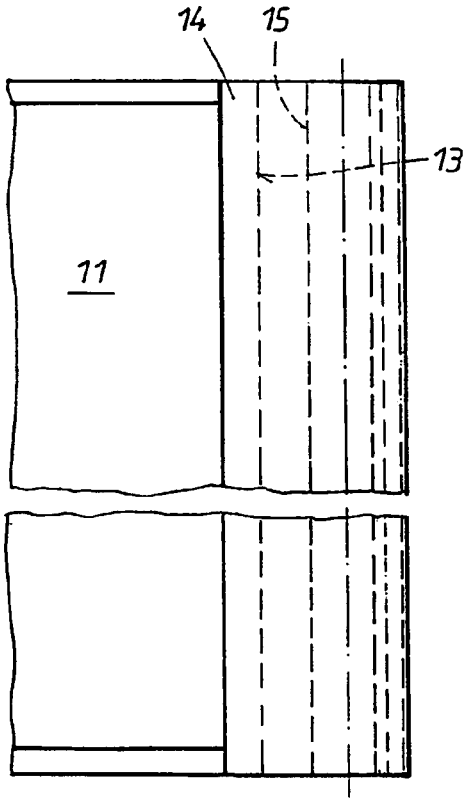
FIG. 3
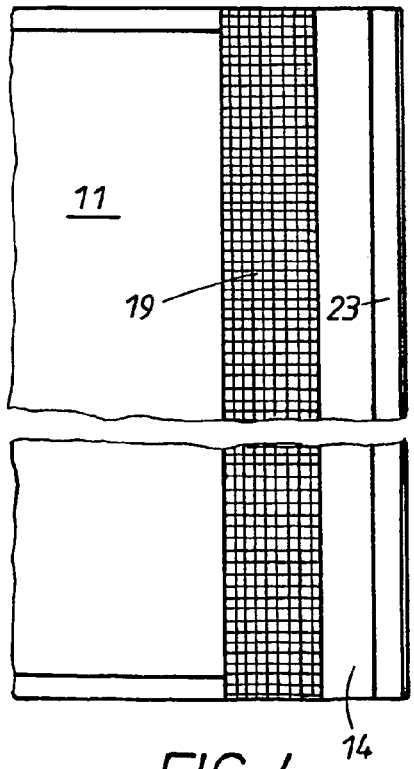
FIG. 4

SLIDING DOOR DEVICE

The invention pertains to a sliding door device comprising a least one movable sliding door and boundary parts for holding and guiding the movable sliding door, which device opens and/or closes a doorway under the command of a control unit, where at least certain edges of the sliding door are enclosed by frame parts; where a blower is able to produce an air curtain, which emerges through a longitudinal opening and passes in front of the doorway; and where the air curtain flows out from an opening in the frame part, which opening extends over nearly the entire length of the vertical edge of the door, the frame part being mounted on the exposed vertical edge of the sliding door. Many different forms of these types of devices are known (see Patent Abstracts of Japan, Vol. 011, No. 214 (M-606), Jul. 11, 1987; and JP 62[1987]-033,234 A (Ebara Corp.; others: 01), Feb. 13, 1987). They are used to seal off the doorways of warehouses, retail shops, airport terminals, etc. As soon as someone approaches, the door opens automatically. As soon as the person in question passes through the doorway, the door closes. The door stays in its open position during periods of continuous actuation, so that only the air curtain is responsible for sealing off the doorway during such periods.

In a design of this type, the air is supplied to each of the two sliding doors through a separate elastic hose, which is mounted, with freedom to stretch, above the sliding doors. The disadvantage here is that, every time the doors move, the elastic hose is stretched or compressed. The hose therefore wears out rapidly, with the result that controls of this type have not become widely adopted. In addition, the long path which the air must travel before arriving at the vertical opening in the door requires that a large amount of air be consumed so that ultimately the air curtain can be formed. The amount of power required to produce the air curtain is also relatively large. Finally, in a design of this type, the blower must be run for a relatively long period of time beforehand to build up the pressure and also be allowed run for a certain period of time afterwards to allow the pressure to decrease. A design of this type has therefore not been widely adopted.

The air curtain device is used to protect the doorway from drafts when the sliding door is opened, because it is often possible for cold fresh air to flow into the room behind the door when it is open. In earlier designs, the air curtain-generating device was located in the floor, in front of the door, so that it could close off the doorway from the bottom to the top. The reverse arrangement would also be possible. Devices of this type, however, were not generally accepted, because, from the viewpoint of the user, the current of air flowing upward from below is perceived as unpleasant or uncomfortable. In addition, these types of air curtain devices consume a large amount of energy and/or are too ineffective from a physical standpoint. Installation at the top of the door is unfavorable because of the long distance involved. An air curtain device has also been proposed for wing-type doors; this device is intended to produce an air current extending laterally from the side, in front of the door. The blower has an air intake and produces an air jet, both of which are on the same side of the door, with the result that the air jet quickly mixes with the intake. A device of this type is inefficient.

The task of the invention is therefore to design a sliding door device of the type indicated above in such a way that it can be installed easily, operated reliably, and used advantageously in the case of an opened door to provide reliable protection for the doorway. In addition, the air curtain device is also intended to consume only a small amount of energy. This task is accomplished in accordance with the invention in that the frame part has a receptacle, in which a blower is installed to produce an air curtain, which is discharged through a nozzle-like outlet, and in that an intake for the blower is provided in the rear surface of the frame part. Because the exposed, vertical edge of the sliding door has a frame part with a receptacle, in which a blower is installed, it becomes easy and simple to produce an air curtain in the area of a doorway. It is also possible to retrofit existing sliding doors with the system, because, to produce the air curtain, it is necessary merely to install the frame part with the receptacle for the blower on the vertical edge of the sliding door. The power supply to the blower can be easily laid through a conduit above the door. Because the outlet of the blower extends along the vertical edge of the door, an air curtain is produced which extends over the entire height of the door and thus shields the doorway. Because the inlet is a certain distance away from the outlet, which can be, for example, on the rear surface of the frame part, the goal is achieved that the intake air and the discharge air will not be able to mix with each other, whereas the inlet, as desired, can draw air in either from one side of the doorway or from the other. The discharge air can flow freely in each case, without interfering with the intake. To produce the air curtain, only one frame part is required, which contains the blower. The air curtain ensures the desired shielding effect and prevents cold air from intruding into the interior through the doorway, which, when desired, can be closed off by the sliding door device. It is advantageous to provide the intake opening on the inside of the sliding door, so that the only heated air from the area inside the door is used to provide the shielding effect of the air curtain. So that the curtain can be as large as possible and as uniform in thickness as possible, it is recommended that the blower extend over nearly the entire height of the door.

It is advantageous for the air curtain produced by the nozzle-like outlet to be at a slight angle to the direction in which the door moves, this angle pointing away from the path of door movement.

This ensures that, when fluctuations in the natural air currents occur, the shielding air curtain will push any air currents which are directed toward the doorway away from the door.

In a special exemplary embodiment of the invention, the blower is switched to a higher power setting when the door is completely open to accommodate the greater width of the doorway. In addition, it is ensured that the power consumption of the air curtain device is minimized. In a special exemplary embodiment, two sliding doors moving in opposite directions are each equipped with a blower. As a result of this measure, the air curtain can shield a wide doorway, and in addition, the shielding is even more effective, because the curtain is generated from both sides of the doorway. It is favorable for the blower to be designed as a tangential or transverse-flow ventilator, because it has been found that such blowers can quickly generate the pressure required for an effective air curtain. In addition, they run quietly and consume only a small amount of energy.

In a special exemplary embodiment of the invention, the rotor of the tangential ventilator in the receptacle has a diameter of $\leqq 90$ mm, especially 45 mm. An arrangement of this type means that the frame on the exposed edge can be made quite narrow. These types of tangential ventilators or tangential blowers can thus be easily installed in doors and frames. It is recommended that the receptacle of the frame part with its inlet and outlet openings on the exposed, vertical edge of the sliding door have a size which is approximately 2 times the diameter of the rotor of the tangential blower. A design of this type offers the advantage that the blower, although it is on the exposed edge of the door, does not become visually intrusive. This size also ensures that, in optical terms, the door does not make a bulky overall optical impression. Nevertheless, this narrow frame part is conspicuous enough visually that no one will walk into the glass door if the door fails to open. A design of this type, furthermore, makes it possible, in spite of the small diameter of the receptacle with its inlet and outlet openings, to be installed in the door frame part. The advantage of tangential ventilators with rotors with diameters of this size ensures that no large masses need to be moved to operate the rotor. In addition, these types of rotors run quietly. They are free of vibrations. The additional advantage of such rotors is that, for a door with a height of 2 m or more, the tangential ventilator can comprise only a single rotor, mounted in the receptacle. This means in turn that the device can be produced and installed quickly and inexpensively. In a special exemplary embodiment for a door with a height of approximately 2 m, the motor of the tangential ventilator has a rotor made of up two sections, which extend out from each side of the motor. As a result of this measure, the blower is held securely in the central area of the door, and the rotor sections can convey the air effectively without being subjected to severe loads. There is very little torsion in the rotor sections themselves, and the air is conveyed uniformly. Finally, the diameters of the rotor sections themselves can be made smaller, because the loads in question are no longer as high.

It has been found favorable for the angle between the current of outgoing air and the line formed by the closed door to be 7°. The air stream points away from the door, so that, when the door is opened, this outward-directed flow offers reliable protection against the intrusion of air, especially cold air, into the room beyond the door. An air stream of this type, which passes in front of the door, also provides a reliable sealing function, so that sudden blasts of air cannot blow dirt from the outside through doorway.

In a special exemplary embodiment of the invention, the air stream emerging from the outlet has a velocity of at least 2 m per second. At this velocity, it is ensured that the open doorway is sealed off reliably. It also ensures that no outside air will be able to enter the room closed off by the door.

In another exemplary embodiment of the invention, at least the vertical frame part for the blower on the exposed edge of the sliding door is made out of foamed metal. As a result of this measure, the sound of the blower is effectively damped, and a frame part of this type is also light in weight, which means that hardly any load is imposed on the sliding door. Finally, foamed metal provides an insulating effect after the door is closed, because the individual foam cells do not allow cold air to pass through the uprights. Finally, the frame part can be attached securely to the exposed vertical edge of the sliding door.

In further characterization of the invention, the frame part on the exposed vertical edge of the door, preferably the lower area of the frame part, carries a sensor to monitor the doorway. Because a sensor is installed directly in front of the door, any objects which may be present there can be easily detected. This makes it possible to prevent the sliding doors, which open and close automatically, from colliding with these objects. A further elaboration of the sensor makes it possible to detect objects such as merchandise from a warehouse. If the merchandise has not been officially released for shipment and thus still carries security identification, it can be detected at the doorway by the sensor, which then triggers an appropriate alarm. The conventional devices installed in doorways to monitor security identification are no longer necessary, because now the door itself can perform the monitoring function. It is advantageous for a sensor on the frame part of one of the sliding doors serving to monitor the doorway to be directed toward the outside of the doorway, whereas the sensor on the frame part of the other sliding door is directed toward the inside of the doorway. The detection angles of the sensor thus make it possible to scan both sides of the door. It is advantageous for the sensor also to have the ability to detect relatively small objects on the floor. Because the sensor is installed in a fixed position, it is not possible for its rotational angle to be changed, because the door itself can scan the corresponding space. It is therefore easier to install than the known designs, especially in regard to location, which is virtually undetectable by a bystander. It is also advantageous for the power to the blower and/or to the sensor to be supplied via the tension cable arrangement which moves the sliding doors back and forth. This arrangement makes it possible, without any additional effort such as the installation of electrical conduits, to provide the power supply safely and easily during the installation of the door via its actuating cables. It is therefore extremely easy to install such doors and also to retrofit existing doors.

In an especially advantageous embodiment, the frame part on the exposed vertical edge of the door, i.e., the frame part which contains the receptacle for the blower, is attached to the lateral surface of the door. The frame part can thus be attached very securely, because a larger surface area of the frame part holding the blower can be fixed in place on a larger section of the glass door.

The design also means that, in practice, only one type of sliding door must be manufactured, because the same type of door can be used for each of the two sliding doors moving in opposite directions. This also applies to the installation of the sensors. The first sensor scans the outer area, and the other sensor scans the inner area of the doorway.

In a special exemplary embodiment of the invention, which pertains in particular to the operation of the sliding door system during winter, the extent to which the doorway is opened by the sliding door can be reduced, and the blower can thus be switched to a lower power setting in order to avoid unnecessary cost. Because the doorway is opened only partially, the air curtain can still reliably seal off the narrower opening actually produced.

It is advantageous for the discharge direction of the nozzle-like outlet slot to be adjustable, so that the door can be adjusted optimally when necessary. If, for example, there is a relatively large pressure difference between the two sides of the doorway, the angle of the outlet slot can be increased to prevent air from passing through the doorway.

Several exemplary embodiments of the object of the invention are illustrated in the drawing:

FIG. 1*a* shows a double sliding door in the closed state;

FIG. 1*b* shows a double sliding door in the open state;

FIG. 2 shows a magnified plan view of the exposed edge of a sliding door;

FIG. 3 shows a view of the front side of a sliding door in the area of the exposed edge;

FIG. 4 shows a view of the rear side of a sliding door; and

FIG. 5 shows a magnified view of the outlet slot with its nozzle opening.

Figure 3A:
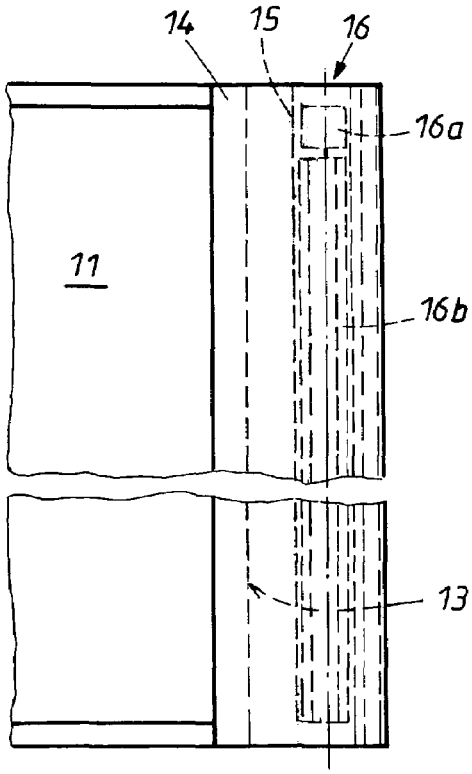
FIG. 3A is a view as in FIG. 3 showing a single rotor.

The sliding door device 10 according to the invention comprises two sliding doors 11, which can be moved in opposite directions. On the basis of the signals it receives from a sensor (not shown), a control unit automatically transmits the commands which open and close the sliding doors. The two sliding doors close off a doorway 20, which separates the interior of the room from the outside. The two sliding doors are guided by and attached to boundary parts 12. These boundary parts also contain the devices which move the sliding doors. The sliding door 11 has cover strips around its edges. On the exposed vertical edge 13 of the sliding door, a frame part 14 is provided; the frame part 14 grips the sliding door, which is made of glass, and at the same time it also forms a contact surface for the opposing sliding door. The frame part is made of a lightweight material.

Each of the two frame parts 14 has a receptacle 15, in which a blower 16 in the form of a tangential ventilator is installed. The receptacle for the blower has an outlet 17 and an inlet 18; the cross section of the inlet is larger than that of the outlet. The outlet is designed in the form of a slot, possibly with interruptions. The two openings extend over the entire height of the door. The outlet can have a nozzle-like shape; it would also be possible to install a separate nozzle element 22. The inlet side is covered by a grating 19.

The sliding door 11 closes off a doorway 20. In the present case, the inlet of the blower 16 is provided on the inner side 21 of the doorway.

In the exemplary embodiment shown here, the air curtain produced by the outlet 17 forms a certain angle 26 to the path of the door 25, as schematically indicated. It should be mentioned that, when the sliding door device is in operation, both blowers are always running, even when the door is closed, although in that case they are running only at low power, so that any gap which may be present at the butt joint between the two frame parts is sealed off.

The frame part, which is shown on a larger scale in FIG. 2, consists of a lightweight material such as foamed metal.

It should also be mentioned here that sensors 23 can be provided on the frame parts 14. One such sensor could cover the doorway 20 on one side in order to detect any objects which may impede the closing movement of the doors. A sensor could also be provided to scan the people coming through from the inside to determine whether they are carrying any merchandise to which an anti-theft device is still attached. A sensor of this type would be provided when, for example, the sliding door device is used to shield the doorway of a commercial establishment.

FIG. 3 shows the front, that is, the outside, surface of the door. It can be seen from this figure that the receptacle containing the blower motor extends over nearly the entire height of the door.

Figure 3B:
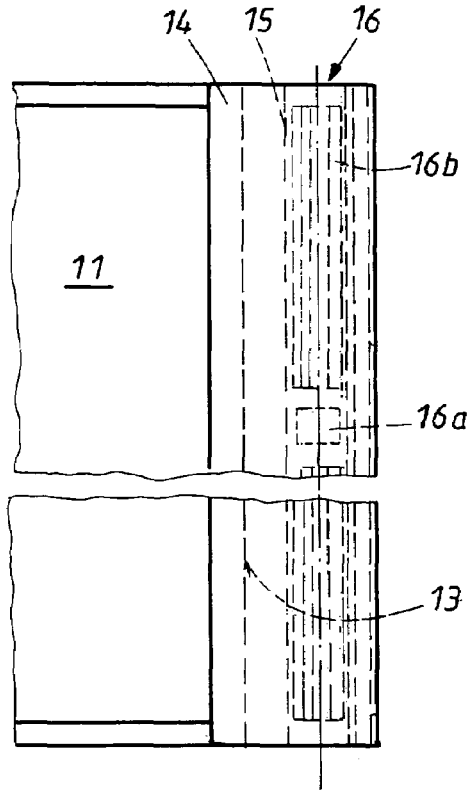
FIG. 3B is a view as in FIG. 3 showing a double rotor.

FIG. 3A shows a blower 16 arranged within the receptacle 15. The blower 16 has a motor 16*a* that turns a single rotor 16*b*. FIG. 3B shows an embodiment in which the motor 16*a* has a rotor 16*b* extending from each side.

FIG. 4 shows the rear surface of the door as indicated by the arrow IV. On the inside is the sensor 23 and also the grating 19, which covers the inlet 18 of the blower.

It can be seen from FIG. 5 that the outlet 17 can be closed off by a nozzle 22. This nozzle makes it possible to change the direction of the air curtain to some extent.

In conclusion, it should be mentioned that only the most essential parts the invention are illustrated for the sake of explanation. The actual methods used to control the doors, to implement the scanning functions, and to move the doors are not shown.

As previously mentioned, the illustrated embodiments represent merely examples of how the invention can be realized. The invention is not limited to them. Instead, many other modifications and applications are possible. For example, the frame part could be narrower than that shown here, which would give the sliding door a larger see-through area. The only important point is that the frame grips the door, holds the blower, and has an inlet and an outlet, which extend advantageously over the entire height of the door in order to create an effective curtain in front of the doorway. It only remains to be remarked that the entire door can be enclosed by cover strips, with the exception of the exposed vertical edge, to which the frame part for the blower is attached. It should also be pointed out that the tangential ventilator comprises a rotor with a motor, the overall length of the ventilator corresponding to the height of the door. The diameter of the rotor is 80 mm or less, which allows the receptacle in the doorframe part to be relatively narrow. The discharge angle of the air current is oriented at an angle of 7° away from the door when the door is closed. The air stream produced by the rotor has an outlet velocity of at least 2 m per second. The expressions "tangential ventilator", "tangential blower", and "transverse-flow ventilator" all indicate the same type of blower. The tangential ventilator can be designed in such a way that it has the motor in the middle, so that the rotors which generate the current of air project out from either side.

LIST OF REFERENCE NUMBERS

10 door device
11 sliding door
12 boundary part
13 exposed vertical edge of the sliding door
14 frame part
15 receptacle in 14
16 blower in 15
17 outlet of 16
18 inlet of 16
19 grating over 18
20 doorway for 10
21 inside of 10
22 nozzle in 17
23 sensor
24 air curtain
25 path along which the doors 11 move
26 angle between the air flow and the direction of movement

The invention claimed is:

1. Sliding door device (10) comprising at least one movable sliding door (11) and boundary parts (12) to hold and guide the movable, sliding doors (11), which automatically open and/or close a doorway (20) under the direction of a control unit, where at least certain edges of the sliding door (11) are enclosed by frame parts (14); where a blower is able to produce an air curtain (24), which emerges through a longitudinal opening and passes in front of the doorway (20); and where the air curtain flows out from an opening (17) in the frame part (14), which opening extends over nearly the entire length of a vertical edge of the door, the frame part being mounted on the exposed vertical edge (13) of the sliding door (11), wherein the frame part (14) has a receptacle (15), in which the blower (16) which produces the air curtain (24) is installed, the curtain being discharged through a nozzle-like outlet (17), and in that the intake (18) for the blower (16) is provided in the frame part (14).

2. Sliding door device according to claim 1, wherein the intake (18) is provided on an inner side (21) of the sliding door.

3. Sliding door device according to claim 1, wherein the blower (16) extends over nearly the entire height of the door (11).

4. Sliding door device according to claim 1, wherein the air curtain (24) produced by the nozzle-like outlet (17) extends at a slight angle (26) to the direction (25) in which the door moves, where the air current of the curtain is directed away from the path (25) along which the sliding door (11) moves.

5. Sliding door device according to claim 1, wherein the blower (16) switches to a higher power setting when the door opens.

6. Sliding door device according to claim 1, wherein each of two sliding doors (11), which move in opposite directions, is equipped with a blower (16).

7. Sliding door device according to claim 1, wherein the blower (16) designed as a tangential or transverse-flow ventilator.

8. Sliding door device according to claim 1, wherein by the rotor of the tangential ventilator (16) in the receptacle (15) has diameter of ≦90 mm, and preferably of 45 mm.

9. Sliding door device according to claim 1, wherein the receptacle (15) in the frame part (14), including its inlet and outlet (17, 18), has a size which is approximately 2 times the diameter of the rotor of the tangential blower (16).

10. Sliding door according to claim 1, wherein, for a door with a height of 2 m, the tangential ventilator has a single rotor in the receptacle (15).

11. Sliding door according to claim 1, wherein, for a door with a height of approximately 2 m, the motor of the tangential ventilator has a section of rotor extending out from each side.

12. Sliding door according to claim 1, wherein the discharge angle of the air stream with respect to the line formed by the closed door (11) is 7°, the air stream being directed away from the door (11).

13. Sliding door device according to claim 1, wherein the air stream has a velocity of at least 2 m per second as it emerges from the outlet (17).

14. Sliding door device, according to claim 1, wherein at least the vertical frame part (14) for the blower (16) on the exposed edge (13) of the sliding door is made of foamed metal.

15. Sliding door device, according to claim 1, wherein the frame part (14) on the exposed vertical edge (13) of the door, preferably the bottom area of frame part, carries a sensor (23) to monitor the doorway.

16. Sliding door device according to claim 15, wherein a sensor (23) is provided on the frame part (14) of a sliding door (11) to scan the doorway, this sensor being directed toward the outside of the doorway (20), whereas the sensor (23) on the frame part of the other sliding door (11) is directed toward the inside (21) of the doorway (20).

17. Sliding door device according to claim 1, wherein power is supplied to the blower (15) and/or to the sensor (23) via a tension cable used to move each of the sliding doors.

18. Sliding door device according to claim 1, wherein the frame part 14 with the blower receptacle (15) is attached to a lateral surface (11) of the door, near the exposed vertical edge (13) of the door.

19. Sliding door device according to claim 1, wherein the blower (16) can be switched to a lower power setting when the sliding door (11) is programmed to reduce the extent to which it opens the doorway (20).

20. Sliding door device according to claim 1, wherein the discharge direction of the nozzle-like outlet slot (17) is adjustable.

* * * * *